United States Patent [19]

Tochacek et al.

[11] Patent Number: 4,750,324

[45] Date of Patent: Jun. 14, 1988

[54] ELASTIC COMPOSITE YARNS FROM BRITTLE CERAMIC YARNS

[75] Inventors: Miroslav Tochacek, Woodbury, Wash.; Lloyd R. White, Minneapolis, Minn.

[73] Assignee: Minnesota Mining and Manufacturing Company, St. Paul, Minn.

[21] Appl. No.: 6,111

[22] Filed: Jan. 23, 1987

[51] Int. Cl.[4] ..... D02G 3/02; D02G 3/04

[52] U.S. Cl. ..... 57/210; 57/229; 57/240; 57/249; 57/903; 428/366

[58] Field of Search ..... 57/200, 207, 210, 222–226, 57/229, 238, 240, 243, 244, 232–235, 6, 7, 16, 903; 428/364, 366, 404

[56] References Cited

U.S. PATENT DOCUMENTS

| | | | |
|---|---|---|---|
| 2,448,782 | 5/1945 | Davis | 57/240 X |
| 2,631,463 | 3/1953 | Waugh | 57/240 X |
| 3,625,809 | 12/1971 | Caroselli et al. | 57/229 X |
| 3,776,293 | 12/1973 | Marzocchi | 57/229 X |
| 3,795,524 | 3/1974 | Sowman | 106/65 |
| 3,948,722 | 4/1976 | Wheeldon et al. | 162/289 |
| 4,072,793 | 2/1978 | Watanabe et al. | 428/255 |
| 4,202,382 | 5/1980 | Westhead | 57/210 X |
| 4,375,779 | 3/1983 | Fischer | 87/6 |
| 4,430,851 | 2/1984 | Sundet | 57/211 |
| 4,484,433 | 11/1984 | Stahlecker et al. | 57/210 X |
| 4,528,223 | 7/1985 | Kumazawa et al. | 57/240 X |

*Primary Examiner*—Donald Watkins

*Attorney, Agent, or Firm*—Donald M. Sell; James A. Smith; Roger R. Tamte

[57] ABSTRACT

The present invention makes possible fabrics stitch-bonded with or knitted from brittle yarns by providing a composite yarn which is able to be used in commercial stitchbonding and knitting machines, the new composite yarn comprising a load-bearing core yarn, a brittle yarn and a wrap yarn which secures the core yarn and the brittle yarn together. The wrap yarn may be helically wrapped around the load-bearing core yarn and the brittle yarn, or the wrap yarn may secure the load-bearing core yarn and the brittle yarn together with a series of connected loops forming a knitted pillar of chain stitches.

37 Claims, 1 Drawing Sheet

ELASTIC COMPOSITE YARNS FROM BRITTLE CERAMIC YARNS

TECHNICAL FIELD

This invention relates to composite yarns containing ceramic yarns, and particularly to composite yarns which are suitable for use in commercial stitchbonding and knitting machines. In another aspect, the present invention relates to articles comprising high temperature fabrics stitchbonded with or knitted from the ceramic composite yarn of the present invention.

BACKGROUND ART

A number of ceramic yarns having a resistance to extremely high temperatures have been developed in recent years. Although advantageous because of their high temperature resistance, inertness, dimensional stability, etc., they are typically very brittle, that is, the yarn has a very limited ability to withstand bending stresses. A ceramic yarn having a particularly high resistance to temperature is that made of alumina-boria-silica fibers which are resistant to temperatures of up to about 1430° C. These alumina-boria-silica fibers are disclosed in U.S. Pat. Nos. 3,795,524 and 4,047,965, with the alumina-boria mol ratio generally being between 3:1 and 24:1.

Brittle high temperature yarns have been incorporated into sewing threads, as disclosed in U.S. Pat. Nos. 4,375,779 and 4,430,851. These high temperature resistant sewing threads can be used to sew together high temperature fabrics to produce an article which is resistant to very high temperatures. However, such high temperature sewing threads are not adapted to use in different types of textile processes such as stitchbonding or knitting operations, which are desired processes for making useful high temperature resistant fabrics. The existing sewing threads are too stiff to be useful in commercially available stitchbonding or knitting machines, as they will not conform to the needles in stitchbonding machines and are too heavy to be used in fine-gauge knitting machines. Further, stitchbonding and knitting machines exert high stresses at short radius bends on the yarns used, and brittle ceramic yarns break when used on such machines. The result has been that brittle ceramic yarns have generally been foreclosed from use in stitchbonded and knitted fabrics.

DISCLOSURE OF INVENTION

The present invention makes possible fabrics stitchbonded with or knitted from brittle yarns by providing a composite yarn (hereinafter sometimes referred to as composite) which is able to be used in commercial stitchbonding and knitting machines. The new composite yarn comprises a load-bearing core yarn, a brittle yarn and a wrap yarn which secures the core yarn and the brittle yarn together. The brittle yarn preferably lies in the yarn with substantially no tension thereon. The wrap yarn may be helically wrapped around the load-bearing core yarn and the brittle yarn, or the wrap yarn may secure the load-bearing core yarn and the brittle yarn together with a series of connected loops forming a knitted pillar of chain stitches. The core yarn and the brittle yarn are preferably not twisted together to allow the load to be borne by the core yarn alone.

The brittle yarn is preferably resistant to temperatures greater than 500° and more preferably to temperatures greater than 1200° C. The brittle yarn is most preferably comprised of alumina-boria-silica fibers, wherein the alumina-boria mol ratio is between about 3:1 and 24:1.

The invention further provides articles comprising a high temperature fabric which is stitchbonded with or knitted from a brittle yarn. The article is stitchbonded with or knitted from a composite of the present invention and the load-bearing core yarn and the wrap yarn are burned away, leaving an article which is stitchbonded with or knitted from only the brittle yarn.

"Brittle" as used herein means having insufficient pliability to withstand short radius bends, or small loop formation without fracturing, as exemplified by not having the ability to be used in stitchbonding or knitting machines without substantial breakage.

"Flexible" as used herein means having sufficient pliability to withstand short radius bends or small loop formation without fracturing, as exemplified by having the ability to be used in commercially available stitchbonding and knitting machines without substantial breakage.

"Yarn" as used herein is a thin strand of one or more monofilaments.

"Composite Yarn" as used herein is a thin continuous cord comprising a plurality of yarns.

"Fabric" as used herein is a woven or nonwoven assembly of fibers and includes thin webs and lofty batts.

DETAILED DESCRIPTION

As indicated above, the brittle yarn and the load-bearing core yarn are secured together with a wrap yarn. Two preferred ways to accomplish the securing are to helically wrap the wrap yarn around the load-bearing core yarn and the brittle yarn, or to secure the load-bearing core yarn and the brittle yarn together with a series of connected loops forming a knitted pillar of chain stitches, referred to hereinafter as knit-wrapped.

Figure 1:
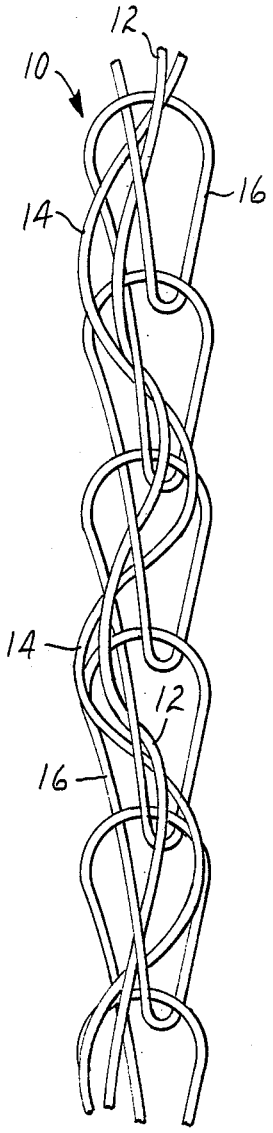
FIG. 1 is a schematic view of a representative portion of one embodiment of the composite yarn of the present invention.

FIG. 1 illustrates a knit-wrapped composite yarn 10 of the present invention. The composite 10 includes a load-bearing core yarn 12, a brittle yarn 14 and a wrap yarn 16. The wrap yarn 16 secures the load-bearing core yarn 12 and the brittle yarn 14 together by means of a series of connected loops which form a chain of loops or knitted pillar of chain stitches.

Figure 2:
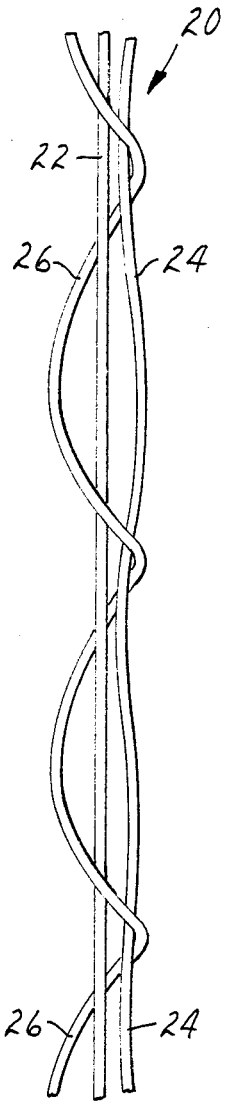
FIG. 2 is a schematic view of a representative portion of a different embodiment of the composite yarn of the present invention.

FIG. 2 illustrates a helically wrapped composite yarn 20 of the present invention. The composite 20 comprises a load-bearing core yarn 22, a brittle yarn 24 and a wrap yarn 26. The wrap yarn 26 secures the brittle yarn 24 and load-bearing core yarn 22 together by means of helical wraps around the load-bearing core yarn 22 and brittle yarn 24.

The brittle yarn is preferably a high temperature resistant ceramic yarn, for example, one which comprises alumina-boria-silica yarns, particularly comprised of individual ceramic filaments whose diameter is preferably about 8 microns or less and with the yarn having a denier in the range of about 300 to 1200. Examples of other brittle yarns include carbon fiber yarns as supplied by Hercules or Amoco and silicon carbide fiber yarns, supplied by Dow Corning as Nicalon.

Such yarns can be sufficiently brittle as to typically have a tensile strength in a short radius bend of less than 100 grams, and even less than 25 grams.

The load-bearing core yarn is flexible and preferably has a high tensile strength and a high modulus of elasticity. The core yarn should have surface roughness sufficient to hold the slack in the brittle yarn but should not be too rough so that slippage between the core yarn and the brittle yarn is entirely prevented. Aromatic polyamide yarns and polyester yarns are illustrative yarns that can be used as load-bearing core yarns. Such yarns may also be used as the wrap yarn; low-tenacity polyester yarns have been proven especially useful as a wrap yarn.

A composite yarn having a helically wrapped configuration typically has between 4 and 10 wraps per cm. A composite having a knit-wrapped configuration typically has between 4 and 12 loops per cm and slack in the weft direction of between 1.5 mm and 10 mm.

The composite yarn of the present invention is flexible having substantially greater tensile strength in a short radius bend test than the brittle yarn, typically greater than 1000 grams. The tensile strength of the composite is typically at least 10 times greater than that of the brittle yarn and often at least 40 times greater when measured in a short radius bend test.

The composite yarn of the invention has particular utility in producing articles with very high temperature resistance. For example, the composite yarn may be used to stitchbond high temperature fabric. When the load-bearing core yarn and the wrap yarn are burned away, a stitchbonded article containing only the brittle yarn remains. Exemplary high temperature fabrics include Fiberfrax from Carborundum, Saffil from Imperial Chemical Industries, Kaowool from Babcock and Wilco, and Ultrafiber non-woven blanket of ceramic fibers, from 3M Company. Also, the composite yarn may be used in commercial knitting machines to produce knit articles. When the core yarn and wrap yarn are burned away, a knit structure of the brittle yarn remains.

The invention is further described by the following non-limiting examples.

EXAMPLES 1-3

A knit-wrapped composite yarn of the invention was prepared using three different types of load-bearing-core yarns. The composite yarns formed had a knit-wrapped pillar of chain stitches with two inlay yarns (the load-bearing core yarn and the brittle yarn) interlocked inside the chain structure. The composite yarn was made on a crochet warp knitting machine, Raschelina/RB, made by Jacob Miller Co., Frick, Switzerland. The basic gauge of the machine was 6 metric, i.e., 6 knitting needles per 1 cm of width. To produce the composite yarn, each fifth needle only was used with four needles removed leaving a clearance of 7.6 mm between any two adjoining needles in the needle bar. Each knitting needle is fed by its own yarn through the lapping guide element set for lapping in the closed chain stitch mode with a 1-0/1-0 repeat. Stitch density was 6 stitches/1 cm of length, i.e., the stitch length is 1.66 mm. The wrap yarn was 90 denier polyester filament yarn, No. 777, produced by the Celanese Co.

The two inlay yarns, the brittle yarn and the load-bearing core yarn, were inserted into the chain structure, each of them by independently controlled tubular yarn guide elements. The load-bearing core yarn, the function of which is to carry the major stress in a subsequent knitting or stitchbonding process, was delivered from cones located on a creel with applied high tension (about 35 grams per end using disc tension brakes). This yarn is guided between the stitching needles in synchronized movement with the needle stroke so that the core yarn is alternately fed into the chain pillar structure first from the left side and in the next stitch from the right side, always without slack. The lateral movement of the load-bearing core yarn guide element is set to a minimum of 1.6 mm which corresponds to the basic pitch between the needles if the full needle set is used. A different yarn was used as the load-bearing core yarn in each of Examples 1-3: Example 1 used an aromatic polyamide yarn (Kevlar 49, 195 denier supplied by duPont), Example 2 used a high tenacity polyester yarn, (T-68, 220 denier supplied by duPont) and Example 3 used a low tenacity polyester yarn, (No. 777, 220 denier supplied by Celanese).

The second inlay yarn, the brittle yarn, an alumina-boria-silica yarn, 600 denier, supplied by 3M as Nexel 312 ceramic fiber yarn, was fed by a second independent guide element as described above but set up in a different mode with a longer lateral (weft) direction stroke of 6 mm. This ceramic yarn was fed from the creel under no tension and passed through the tubular yarn guide elements and was locked into the chain stitch pillar. The final product consisted of a taut load-bearing core yarn next to the brittle ceramic yarn with the two held together by the light knit-wrapped, wrap yarn.

The composite yarns of the examples, and the individual components of the composite yarns were tested and the results are presented in tables 1-4.

The test data includes the peak load in pounds and the strain at peak load measured in both a standard tensile strength test and in a needle hook bend test. In the latter test the yarn or composite yarn is looped over the hook of a stitchbonding needle, gauge 40, and pulled in a tensile testing machine to measure the pounds of force before breaking. In the table "n" is the number of observations, "X" is the average value and "(S)" is the standard deviation.

Note the inelasticity of the ceramic yarn by itself compared to the composite yarns. Strain at peak load for the Nextel ceramic fiber yarn alone is 1.6% while it is greater than 10% in all the composites. Thus the composite yarns can be stretched during processing without breaking whereas the ceramic yarn alone is nearly inelastic.

Also, note the results for the needle hook bend test. Composite yarns break at loads ranging from 2.5 to 12 pounds, while Nextel 600 denier ceramic fiber yarn breaks at about 0.02 pounds. The ceramic yarn by itself has essentially no strength when pulled by a stitchbonding needle.

TABLE 1

| | (Results for Individual Yarns) | | | | |
|---|---|---|---|---|---|
| | | PEAK LOAD (pounds) | | STRAIN AT PEAK LOAD (%) | |
| COMPONENT | n | X | (S) | X | (S) |
| Nextel 600 denier | 16 | 4.3 | (1.2) | 1.6 | (0.3) |

TABLE 1-continued (Results for Individual Yarns)

| COMPONENT | n | PEAK LOAD (pounds) X | PEAK LOAD (pounds) (S) | STRAIN AT PEAK LOAD (%) X | STRAIN AT PEAK LOAD (%) (S) |
|---|---|---|---|---|---|
| yarn | | | | | |
| 90 denier polyester wrap yarn | 11 | 1.9 | (0.2) | 19.0 | (1.8) |
| Kevlar 49 | 14 | 8.4 | (0.7) | 4.6 | (0.7) |
| T-68 220 denier high tenacity polyester | 10 | 3.7 | (.04) | 25 | (1.7) |
| Celanese 777, 220 denier low tenacity polyester | 10 | 3.3 | (.07) | 27 | (1.9) |

Sample length = 6⅞ inches
Crosshead = 0.5 in/min

TABLE 2

(Results of Composite Yarns of Example 1)

| COMPONENT | n | PEAK LOAD (pounds) X | PEAK LOAD (pounds) (S) | STRAIN AT PEAK LOAD (%) X | STRAIN AT PEAK LOAD (%) (S) |
|---|---|---|---|---|---|
| Tensile test, composite | 13 | 12.7 | (1.5) | 11.9 | (1.1) |
| Needle hook bend test, composite | 11 | 12.0 | (1.7) | 6.0 | (8.9) |
| Needle hook bend test, Nextel 600 yarn | 13 | 0.022 | 0.009 | — | — |

Sample length = 6⅞ inches
Crosshead = 0.5 in/min

TABLE 3

(Results of Composite Yarn of Example 2)

| YARN | n | PEAK LOAD (pounds) X | PEAK LOAD (pounds) (S) | STRAIN AT PEAK LOAD (%) X | STRAIN AT PEAK LOAD (%) (S) |
|---|---|---|---|---|---|
| Tensile test, Composite | 11 | 8.3 | (0.5) | 10.8 | (1.0) |
| Needle hook bend test, composite | 10 | 8.5 | (0.9) | 8.0 | (1.1) |
| Needle hook bend test, Nextel 600 yarn | 13 | 0.022 | 0.009 | — | — |

Sample length = 6⅞ inches
Crosshead = 0.5 in/min

TABLE 4

(Results of Composite Yarns of Example 3)

| YARN | n | PEAK LOAD (pounds) X | PEAK LOAD (pounds) (S) | STRAIN AT PEAK LOAD (%) X | STRAIN AT PEAK LOAD (%) (S) |
|---|---|---|---|---|---|
| Tensile test, Composite yarn | 13 | 6.2 | (1.2) | 11.9 | (0.7) |
| Needle hook bend test, composite | 11 | 2.5 | (0.3) | 8.8 | (2.2) |
| Needle hook bend test, Nextel 600 yarn | 13 | 0.022 | 0.009 | — | — |

Sample length = 6⅞ inches
Crosshead = 0.5 in/min

EXAMPLE 4

In this example two previously prepared ceramic fabrics were stitchbond together using a composite yarn of the invention to prepare a high-temperature resistant article. This article consisted of two layers of Nextel Ultrafiber non-woven blanket of ceramic fibers, consisting of discontinuous alumina-boria-silica fibers having a length ranging from less than 1 cm to several inches, and having an average filament diameter of 3 ½microns. The two layers of the non-woven blanket of ceramic fibers were placed between two fabric scrims and stitched together with the composite yarn of the invention using an Arachne stitchbonding machine with 40 gauge needles. Stitching was done by a one lapping bar chain stitch with space of 10 mm between the stitching needles so that 10 pillars of stitches were made per 100 mm of fabric width and with 25 courses per 10 cm in the machine direction. Stitching speed was 300 stitches/minute.

Each layer of Ultrafiber non-woven blanket of ceramic fibers had a basis weight of 221 g/sq m (6.5 oz/sq yd) and each fabric scrim had a basis weight of 54.3 g/sq m (1.6 oz/sq yd). Total fabric weight was about 543 g/sq m (16 oz/sq yd). $crims were woven in a plain weave pattern with 3.9 yarns/cm (10 yarns/inch) in both warp and weft from Nextel 312 ceramic yarn 600-denier yarn in which filament diameter was 8 microns. Average diameter of the discontinuous filaments comprising the Ultrafiber non-woven blanket of ceramic fabric was 3.5 microns.

The knit-wrapped composite yarn of the invention consisted of one load-bearing core yarn of 220 denier High Tenacity polyester type T-68 made by the Dupont Co., a brittle ceramic yarn of Nextel 312, 600 denier ceramic fiber yarn with filament diameter of 8 microns, and a wrap yarn made with 90 denier polyester type 777 yarn made by Celanese Corp. The composite yarn was prepared as described in Examples 1–3 so that there was slack in the ceramic yarn portion of the composite and the loads and impulses produced by the stitching process were borne by the polyester load-bearing core yarn. The core yarn and wrap yarn were burned away leaving an article with good integrity with very little breakage of the ceramic yarn.

EXAMPLE 5

A high temperature resistant article of the invention was prepared as in Example 4 except that the load-bearing core yarn of the composite yarn was Kevlar 29 made by the Dupont Co.

EXAMPLE 6

A high temperature resistant article of the invention was prepared as in Example 4 except that the load-bearing core yarn of the composite yarn was a low tenacity polyester, 220 denier, type 777 made by Celanese Corp.

EXAMPLE 7

A high temperature resistant article of the invention was prepared as in Example 4 except that the composite yarn contained a core yarn of Kevlar 29 and the brittle ceramic yarn was made from Nextel 312, 300 denier filament ½ twisted yarn and plied at 1.15 twists/cm (2.75 twists per inch).

EXAMPLE 8

A high temperature resistant article of the invention was prepared as in Example 4 except that the core yarn and brittle ceramic yarn of the composite yarn were helically wrapped using a 90 denier polyester type 777 wrap yarn instead of knit-wrapped.

EXAMPLE 9

A high temperature resistant article of the invention was prepared as in Example 4 except that from three to six layers of Nextel Ultrafiber non-woven blanket of ceramic fibers were used instead of two. Fabric weight increased accordingly so that a three layer structure had a basis weight of about 781 g/sq m (23 oz/sq yd).

EXAMPLE 10

A high temperature resistant article of the invention having a knit structure was prepared using the composite yarn of the invention. A flat-bed knitting machine was set up to use a single bed to make a flat fabric of a plain or jersey structure. Machine gauge was 8 needles/inch and knitting was done at 14 courses/inch in the machine direction. The composite yarn was composed of a brittle yarn of 600 denier Nextel ceramic fiber yarn with a core yarn of 220 denier high tenacity polyester type T-68 (duPont) yarn and knit-wrapped with 90 denier polyester type 777 (Celanese) yarn. The filament diameter of the Nextel ceramic fiber yarn was 8 $\mu$. After heat cleaning to remove the polyester core and wrapping yarns a knit structure remained which was composed entirely of Nextel ceramic fiber yarn and which had good integrity.

EXAMPLE 11

A helically wrapped composite yarn of the invention was prepared using a Saurer Type ESP-F twisting machine. In this machine the brittle yarn and core yarn were helically wrapped with a wrap yarn to hold them together. The brittle ceramic yarn was laid in under little or no tension and the core yarn was laid in under tension so that when it relaxes, there was slack in the ceramic yarn. The resultant composite yarn was elastic.

The brittle core yarn was Nextel 312 ceramic fiber yarn of 600 denier and was fed at a rate of 40 meters/minute. The load-bearing core yarn was a spun polyvinylacetate, 20/1 ECC Kuralon and was fed at a rate of 37.5 meters/minute. By overfeeding the brittle yarn, a composite was produced in which there was slack in the brittle yarn component. The brittle yarn and core yarn were wrapped at a rate of 10 turns/inch using 140 denier high tenacity polyester yarn.

What is claimed is:

1. A composite yarn adapted for use in stitchbonding or knitting operation comprising:

(a) a flexible load-bearing core yarn, (b) a brittle yarn, and (c) a flexible wrap yarn which secures said core yarn and said brittle yarn together, wherein said core yarn, said wrap yarn and said composite yarn have a greater tensile strength in a short radius bend than that of the said brittle yarn by itself.

2. The composite yarn of claim 1 wherein said brittle yarn lies in said composite yarn in a slack, substantially untensioned state.

3. The composite yarn of claim 1 wherein said wrap yarn is helically wrapped around said core yarn and said brittle yarn.

4. The composite yarn of claim 1 wherein said wrap yarn secures said core yarn and said brittle yarn with a series of connected loops.

5. The composite yarn of claim 1 wherein said brittle yarn has a tensile strength in a short radius bend of less than 100 grams.

6. The composite yarn of claim 1 wherein said brittle yarn has a tensile strength in a short radius bend of less than 25 grams.

7. The composite yarn of claim 1 having a tensile strength in a short radius bend of at least 1000 grams.

8. The composite yarn of claim 1 wherein said composite yarn has a tensile strength in a short radius bend, at least ten times greater than the tensile strength of said brittle yarn in a short radius bend.

9. The composite yarn of claim 8 wherein said tensile strength of said composite yarn is at least forty times greater than said tensile strength of said brittle yarn.

10. The composite yarn of claim 1 wherein said brittle yarn is resistant to temperatures greater than 500° C.

11. The product of claim wherein said brittle yarn is resistant to temperatures greater than 1200° C.

12. The composite yarn of claim 1 wherein said brittle yarn is comprised of alumina-boria-silica fibers wherein the alumina-boria mol ratio is between about 3:1 and 24:1.

13. The composite yarn of claim 12 wherein said brittle yarn has a denier in the range of 300 to 1200 and is comprised of individual filaments of said alumina-boria-silica fibers whose diameter is about 8 microns or less.

14. The composite yarn of claim 3 wherein said wrap yarn has between about 4 and 10 wraps per cm.

15. The yarn of claim 4 wherein said wrap yarn has between about 4 and 12 loops per cm.

16. An article comprising a high temperature fabric stitchbonded together with a brittle yarn said yarn having a tensile strength in a short radius bend of less than 100 grams.

17. The article of claim 16 wherein said brittle yarn has a tensile strength in a short radius bend of less than 25 grams.

18. The article of claim 16 wherein said brittle yarn is resistant to temperatures greater than 1200° C.

19. The article of claim 18 wherein said brittle yarn is comprised of alumina-boria-silica fibers wherein the alumina-boria mol ratio is between about 3:1 and 24:1.

20. An article comprising a knitted structure that consists essentially of an untwisted, brittle yarn said brittle yarn having a tensile strength in a short radius bend of less than 100 grams.

21. The article of claim 20 wherein said brittle yarn has a tensile strength in a short radius bend of less than 25 grams.

22. The article of claim 20 wherein said brittle yarn is resistant to temperatures greater than 1200° C.

23. The article of claim 22 wherein said brittle yarn is comprised of alumina-boria-silica fibers wherein the alumina-boria mol ratio is between about 3:1 and 24:1.

24. A composite yarn adapted for use in stitchbonding or knitting operation comprising:

(a) a flexible load-bearing core yarn, (b) a ceramic yarn, and (c) a flexible wrap yarn which secures said core yarn and said ceramic yarn together, wherein said core yarn, said wrap yarn and said composite yarn have a greater tensile strength in a short radius bend than that of the said ceramic yarn by itself.

25. The composite yarn of claim 24 wherein said ceramic yarn lies in said composite yarn in a slack, substantially untensioned state.

26. The composite yarn of claim 24 wherein said wrap yarn is helically wrapped around said core yarn and said ceramic yarn.

27. The composite yarn of claim 24 wherein said wrap yarn secures said core yarn and said ceramic yarn with a series of connected loops.

28. The composite yarn of claim 24 wherein said ceramic yarn has a tensile strength in a short radius bend of less than 100 grams.

29. An article comprising a high temperature fabric stitchbonded together with the yarn of claim 1.

30. The article of claim 29 wherein said brittle yarn has tensile strength in a short radius bend of less than 25 grams.

31. The article of claim 29 wherein said brittle yarn is resistant to temperature greater than 1200° C.

32. The article of claim 31 wherein said brittle yarn is comprised of alumina-boria-silica fibers wherein the alumina-boria mol ratio is between about 3:1 and 24:1.

33. An article comprising a knitted structure made of the yarn of claim 1.

34. The article of claim 33 wherein said brittle yarn has a tensile strength in a short radius bend of less than 100 grams.

35. The article of claim 33 wherein said brittle yarn has a tensile strength in a short radius bend of less than 25 grams.

36. The article of claim 33 wherein said brittle yarn is resistant to temperatures greater than 1200° C.

37. The article of claim 36 wherein said brittle yarn is comprised of alumina-boria-silica fibers wherein the alumina-boria mol ratio is between about 3:1 and 24:1.

* * * * *

UNITED STATES PATENT AND TRADEMARK OFFICE

CERTIFICATE OF CORRECTION

PATENT NO. : 4,750,324

DATED : June 14, 1988

INVENTOR(S) : Miroslav Tochacek and Lloyd R. White

It is certified that error appears in the above-identified patent and that said Letters Patent is hereby corrected as shown below:

In the Specification

Col. 5, line 66, "stitchbond" should read --stitchbonded--.

Col. 6, line 20, "$crims" should read --Scrims--.

In the Claims

Col. 8, line 15, "claim" should read --claim 1--.

Signed and Sealed this

Sixth Day of December, 1988

*Attest:*

*Attesting Officer*

DONALD J. QUIGG

*Commissioner of Patents and Trademarks*